US007382889B2

(12) United States Patent
Akino

(10) Patent No.: US 7,382,889 B2
(45) Date of Patent: Jun. 3, 2008

(54) CONDENSER MICROPHONE

(75) Inventor: Hiroshi Akino, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 465 days.

(21) Appl. No.: 11/064,080

(22) Filed: Feb. 24, 2005

(65) Prior Publication Data

US 2005/0185807 A1 Aug. 25, 2005

(30) Foreign Application Priority Data

Feb. 25, 2004 (JP) ..... 2004-049149

(51) Int. Cl.
*H04R 25/00* (2006.01)

(52) U.S. Cl. ..... 381/113; 381/111; 381/384

(58) Field of Classification Search ..... 381/113, 381/111, 361, 384; 323/232
See application file for complete search history.

(56) References Cited

U.S. PATENT DOCUMENTS 6,084,972 A * 7/2000 van Halteren et al. ..... 381/111

* cited by examiner

*Primary Examiner*—Suhan Ni
(74) *Attorney, Agent, or Firm*—Manabu Kanesaka

(57) ABSTRACT

The present invention prevents the occurrence of noise caused by an external electromagnetic wave. The present invention also prevents a high voltage from appearing in the microphone case, thus avoiding the possibility of an electric shock. A condenser microphone includes a conductive microphone case 10 containing an electronic circuit 20 for a condenser microphone unit and a 3-pin type output connector 30 attached to the microphone case 10 and to which a microphone cable 40 from an external apparatus including a polarization power source is connected. A first pin for grounding included in the output connector 30 is connected directly to the microphone case 10 and is also connected to a ground of the electronic circuit 20 via a high-frequency choke coil 31.

3 Claims, 1 Drawing Sheet

CONDENSER MICROPHONE

TECHNICAL FIELD

The present invention relates to a condenser microphone, and more specifically, to a technique for preventing the occurrence of noise due to a high-frequency electromagnetic noise generated by a cellular phone, for example.

BACKGROUND ART

A condenser microphone comprises a condenser microphone unit having a very high impedance. Accordingly, the condenser microphone contains an impedance converter such as an FET (field effect transistor). Typically, a phantom power source is used in the condenser microphone. A microphone output is provided via a balanced shield cable of the phantom power source.

For example, a hand (hand-held) microphone normally comprises a 3-pin type output connector. The microphone can be attached to and detached from a microphone cable. The output connector is specified in EIAJ RC-5236 "Latch Lock Type Round Connector for Acoustic Equipment". By way of example, as shown in Patent Document 1 (Japanese Patent Application Publication No. H11-341583), a cylindrical base consisting of an electric insulator is penetrated by three pins, a first pin for grounding, a second pin used as a hot side of a signal, and a third pin used as a cold side of a signal.

A microphone case is a shield case consisting of a metal material, for example, brass. The microphone case contains an electronic circuit comprising an output circuit including an impedance converter for the condenser microphone unit and a polarization voltage generating circuit, or the like. However, when an intense electromagnetic wave is applied to the microphone or microphone cable, it may enter the microphone case via the output connector from the microphone cable. The electromagnetic wave is then demodulated by the impedance converter. As a result, noise of an audible frequency may be output from the microphone.

As a technique for preventing noise resulting from the entry of an electromagnetic wave from the output connector into the microphone case, a method has been proposed which connects the ground of the electronic circuit to the microphone case by wiring and which then couples the grounding first pin, included in the output connector, directly to the microphone case (see Non-Patent Document 1; Jim Brown and David Josephson "Radio Frequency Susceptibility of Capacitor Microphones" Audio Engineering Society Convention Paper 5720 (p. 12, FIG. 8)).

The method described in Non-Patent Document 1 prevents a loop current path from being formed by the floating capacity between the electronic circuit and the microphone case. Further, this method does not involve wiring joining the grounding first pin and the ground of the electronic circuit together, that is, it does not involve anything acting as an antenna. This makes it possible to effectively prevent the entry of an electromagnetic wave.

However, according to the method described in Non-Patent Document 1, the grounding first pin is coupled directly to the microphone case, so that the use of the phantom power source results in the passage of a current through the microphone case. Consequently, if the grounding first pin gets detached from the microphone case for any reason, the potential of the microphone case may increase to 30 V or higher in the case of a 48-V phantom power source.

In this case, touching the microphone case with the hand may result in an electric shock.

SUMMARY OF THE INVENTION

It is thus an object of the present invention to provide a condenser microphone in which a grounding first pin included in an output connector is coupled directly to a microphone case as disclosed in Non-Patent Document 1 in order to prevent the entry of an electromagnetic wave of a high frequency from a 3-pin type output connector into the microphone case, the electromagnetic wave possibly causing noise, the condenser microphone avoiding the possibility of an electric shock even if the grounding first pin gets detached from the microphone case for any reason.

To accomplish this object, the present invention provides a condenser microphone including a conductive microphone case containing an electronic circuit for a condenser microphone unit and a 3-pin type output connector attached to the microphone case and to which a microphone cable from an external apparatus including a polarization power source is connected, the microphone being characterized in that a ground pin included in the output connector is connected directly to the microphone case and is also connected to a ground of the electronic circuit via a high-frequency choke coil.

With this configuration, a high frequency current induced by an external electromagnetic wave does not enter the electronic circuit. The current thus flows through the microphone case. Since the ground pin is connected directly to the ground of the electronic circuit, even if the ground pin gets detached from the microphone case, the potential of the microphone case does not rise. Therefore, there is no possibility of an electric shock.

Further, the present invention is characterized in that the high-frequency choke coil is mounted on a circuit board of the electronic circuit. Since the high-frequency choke coil is mounted on the circuit board of the electronic circuit, the possibility of an electric shock can be avoided unless the circuit board is broken.

DETAILED DESCRIPTION

Figure 1:
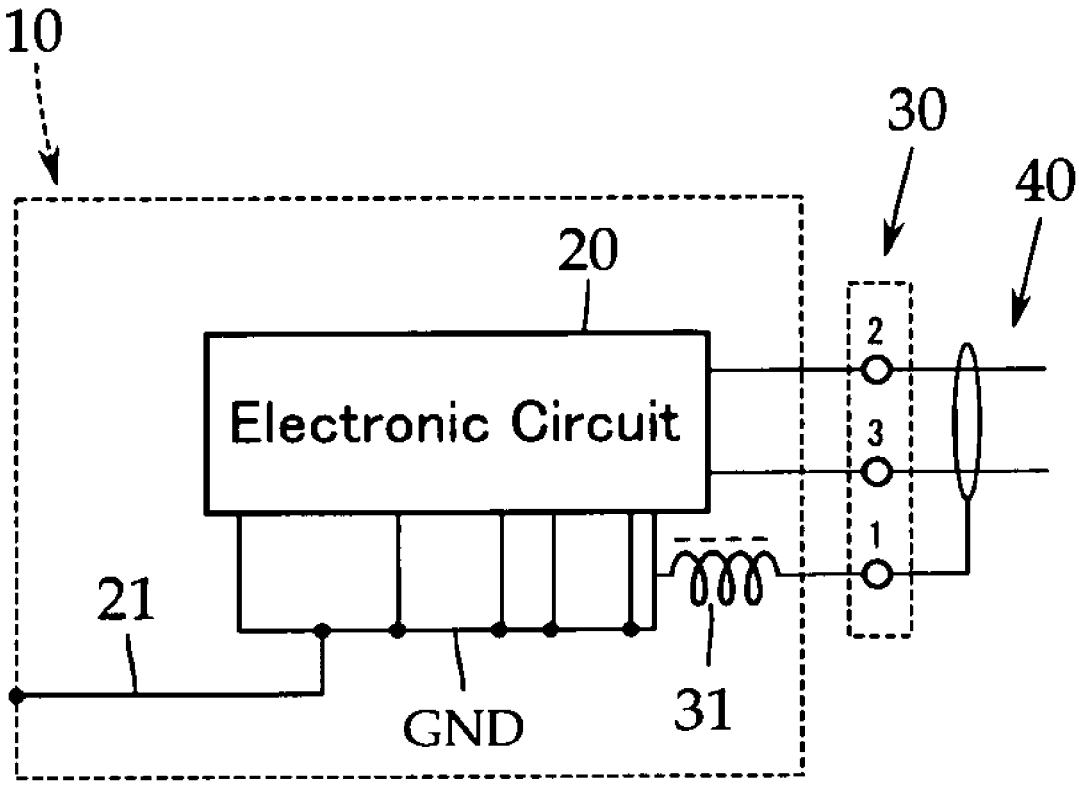
FIG. 1 is a schematic view showing the configuration of an essential part of a condenser microphone according to the present invention.

Now, an embodiment of the present invention will be described with reference to FIG. 1. However, the present invention is not limited to this. FIG. 1 is a schematic view showing the configuration of an essential part of a condenser microphone according to the present invention.

A part shown at reference numeral 10 with a chain line frame in FIG. 1 is a microphone case of a condenser microphone according to the present invention. The microphone case 10 is a shield case and thus consists of a metal material such as brass which is conductive. In the case of a hand (hand-held) microphone, the microphone case 10 is used as a grip portion gripped by the hand.

The microphone case 10 contains an electronic circuit 20 for a condenser microphone unit (not shown). Although not shown in detail, an FET as an impedance converter and a polarization voltage generating circuit are mounted in the electronic circuit 20. GND is a ground of the electronic circuit 20 and is connected (grounded) to the microphone case 10 via a predetermined wiring cord 21.

The microphone case 10 is provided with an output connector 30. The output connector 30 connects to a microphone cable (balanced shield cable) 40 from an external apparatus (not shown) including, for example, a phantom power source. The output connector 30 is composed of a 3-pin type connector specified in EIAJ RC-5236 "Latch Lock Type Round Connector for Acoustic Equipment".

That is, the output connector 30 comprises a (shielding) first pin for grounding, a second pin used as a hot side of a signal, and a third pin used as a cold side of a signal. Reference numerals "1", "2", and "3" in the FIGURE correspond to the first, second, and third pins, respectively.

The second and third pins for signals are connected to a predetermined input and output terminals of the electronic circuit 20. The grounding first pin 1 is connected directly to the microphone case 10. Further, the grounding first pin is connected to the ground GND of the electronic circuit 20 via the high-frequency choke coil 31.

With this configuration, a high frequency current attributed to an external electromagnetic wave does not flow from the grounding first pin into the electronic circuit 20 but through the microphone case 10. Further, the grounding first pin and the electronic circuit 20 are connected together in series. Consequently, even if the grounding first pin gets detached from the microphone case 10 for any reason, the voltage of the microphone case 10 does not rise. This avoids the possibility of an electric shock.

Preferably, the high frequency choke coil 31 is mounted on the circuit board of the electronic circuit 20, and the high-frequency choke coil 31 and the grounding first pin are connected together on the circuit board. This serves to maintain the connection between the high-frequency choke coil 31 and the grounding first pin unless the circuit board is broken. Therefore, safety is improved.

The preferred embodiment of the present invention has been described with reference to the drawing. However, the present invention is not limited to this embodiment. Of course, the scope of the present invention includes many variations and modifications that will occur to those who skilled in the art of microphones and having ordinary technical knowledge in the art.

The invention claimed is:

1. A condenser microphone comprising:

a condenser microphone unit, an electronic circuit for the condenser microphone unit, said electronic circuit having a ground, a conductive microphone case containing the electronic circuit therein, a 3-pin output connector attached to the microphone case and connected to a phantom power source through a microphone cable, said 3-pin output connector having a ground pin connected directly to the microphone case, and a high-frequency choke coil connected to the ground of the electronic circuit through the ground pin so that high frequency current attributed to an external electromagnetic wave does not flow from the ground pin into the electronic circuit but flows through the microphone case.

2. The condenser microphone according to claim 1, wherein the high-frequency choke coil is mounted on a circuit board of the electronic circuit.

3. The condenser microphone according to claim 1, wherein the ground pin and the electronic circuit are connected in series so that if the ground pin is detached from the microphone case, voltage of the microphone case does not rise.

* * * * *